United States Patent [19]

Cherbourg et al.

[11] 4,158,270

[45] Jun. 19, 1979

[54] DEVICE FOR DRIVING SLIDING WINDOWS

[75] Inventors: Robert Cherbourg, Rueil; Jean-Pierre Falluel, Pierrelaye; Michel Menard, Beynes, all of France

[73] Assignee: Regie Nationale des Usines Renault, Billancourt, France

[21] Appl. No.: 877,471

[22] Filed: Feb. 13, 1978

[30] Foreign Application Priority Data

Feb. 11, 1977 [FR] France ..... 77 03887

[51] Int. Cl.[2] ..... E05F 5/12

[52] U.S. Cl. ..... 49/103; 49/136; 49/352; 49/360

[58] Field of Search ..... 49/136, 352, 123, 102, 49/103, 98, 360

[56] References Cited

U.S. PATENT DOCUMENTS

| | | | |
|---|---|---|---|
| 860,518 | 7/1907 | Best | 49/136 |
| 2,614,836 | 10/1952 | Williams | 49/136 X |
| 3,965,618 | 6/1976 | Pickles | 49/103 |

*Primary Examiner*—Kenneth Downey

*Attorney, Agent, or Firm*—Oblon, Fisher, Spivak, McClelland & Maier

[57] ABSTRACT

A device for the driving of sliding panels, especially horizontally-sliding windows in an automobile, including a crank driving a command part which transmits its movement to several panels sliding in their plane, one relative to the other and in a predetermined direction, characterized by the fact that the transmission of movement is achieved by cables and pinions, and the command part is a plate having one or more grooved sections cogged and concentric, forming alternate racks with partial cogs which can drive a receiver pinion whose simultaneous or successive rotations in the same direction or in opposite directions for a predetermined rotation direction of the crank allow the panels to be driven relatively, according to the same operational sequence, predetermined by the configuration of the cogged sections.

5 Claims, 14 Drawing Figures

DEVICE FOR DRIVING SLIDING WINDOWS

BACKGROUND OF THE INVENTION

The present invention relates to a mechanism for relative, and if necessary, simultaneous driving of several mobile panels in their plane, and in particular with a device allowing displacement, simultaneous or not, in both directions, of sliding windows in an automobile, as well as blocking them at all positions.

Currently, in the automobile, horizontally-sliding windows include one or two panes which may be relatively displaced in a simple or double sliding groove, assuring both guidance and tightness on both surfaces and the furrow.

The sliding manuever of a pane is obtained by an operator pushing directly on the pane itself, or more conveniently by means of an inside button also assuring interlock of the pane in various positions. Furthermore, the interlock of the closed panes is practically obligatory to assure the inviolability of the vehicle from the outside. The interlock of a pane is thus achieved with regard to the door panel or the other pane.

Users are accustomed to manipulating the panes of their vehicle by means of a crank handle placed on the inside panel of the door, windows descending vertically being the most current type.

SUMMARY OF THE INVENTION

Accordingly, an object of the invention is to mechanize the displacements of the horizontally-sliding windows by means of a device activated also by a crank handle involving transforming the rotational movement of the crank into a rectilinear-horizontal conveyance movement printed on the sliding windows, while respecting the requirements mentioned in the forward.

The objects of the invention are achieved by a device for conveyance driving of sliding panels, notably horizontally-sliding panes in an automobile, characterized by a crank communicating its continuous circular movement to a command part followed by at least one movement transmission part so as to obtain one or several alternate rectilinear movements, and at least one linking part capable of imparting these movements to several panels such as panes sliding in their plane, one relative to the other and in any direction, simultaneously or successively according to a predetermined operational sequence by the configuration of the command part.

According to an essential characteristic of the invention, the command part includes a circular plate which is driven along its cogged edge by a pinion of the crank and which has one or several grooved, cogged, and concentric sections forming alternate racks with partial cogs which can each be driven by a receiver pinion in one direction or the other.

Each cogged section alternately defines one or several driving zones of the corresponding receiver pinion, zones of variable lengths probably separated by zones of rest without cogs and of lesser width on which the pinion remains blocked in rotation without interrupting the course of the plate. This mechanical system allows blocking the windows in certain positions which are predetermined and thus assures the inviolability of the vehicle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
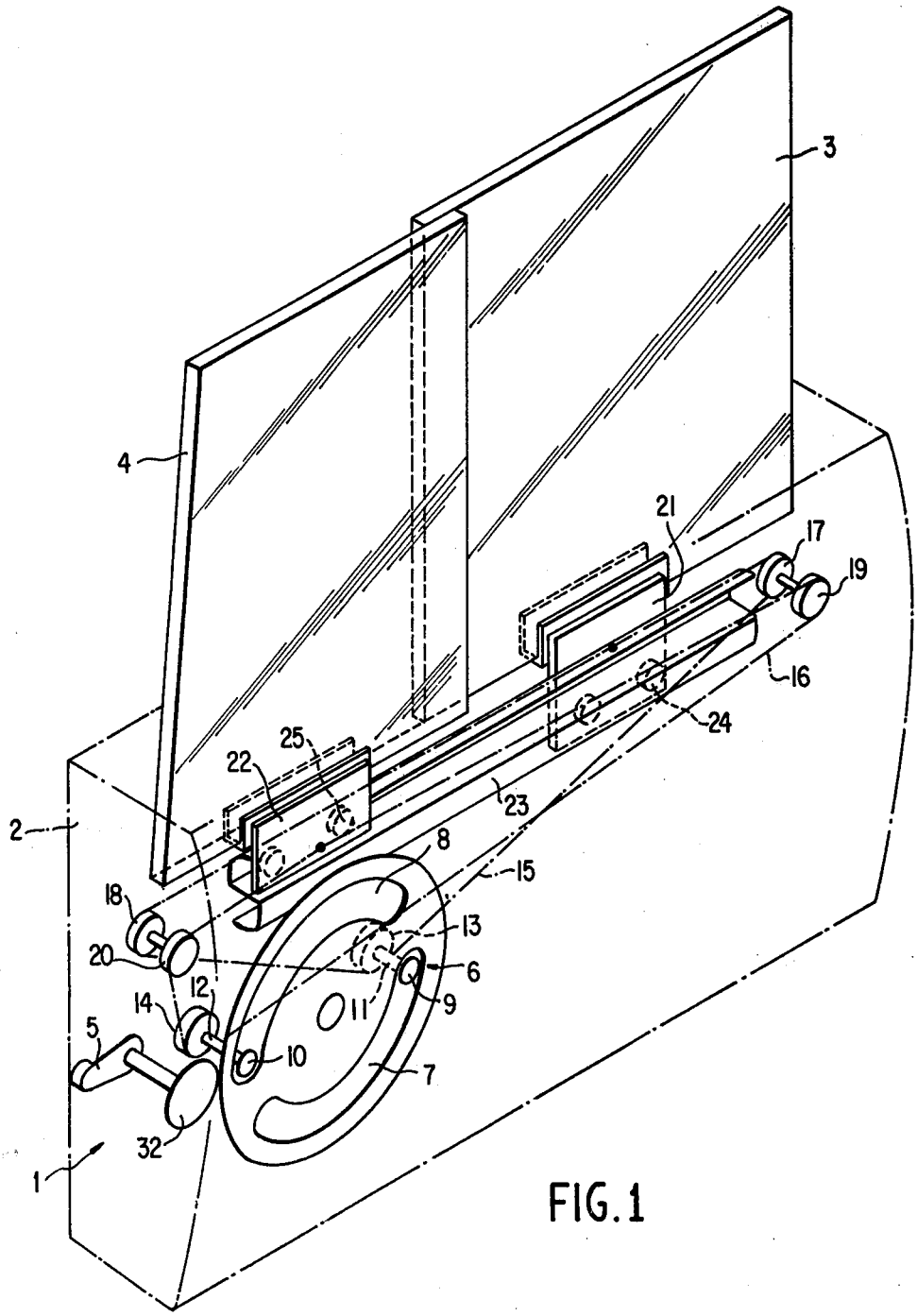
FIG. 1 represents in perspective the complete driving device applied to two sliding windows mounted on a vehicle door.

Referring now to the drawings, wherein like reference numerals designate identical or corresponding parts throughout the several views, and more particularly to FIG. 1 thereof, the driving device 1 is mounted inside a door case 2 so as to displace in their plane and on reopening, two horizontally-sliding panes, respectively inside 3 and outside 4. The mechanism is activated by a crank 5 engaging a cogged plate 6 which constitutes the command part and movement transmission part of the device. For this purpose, the plate 6 is furnished with two sections 7, 8 grooved with alternating partial cogs which engage two receiver pinions 9, 10 whose axes 11, 12 support in turn two drums 13, 14 which are independent. Each drum is put in motion by an alternate circular motion corresponding to the command program of plate 6.

This movement is transformed into a rectilinear alternate movement through a transmission cable 15, 16 wound around each drum and hung between two loose pulleys respectively 17, 18, and 19, 20 mounted on the body. Each cable is made solid by a pane-support piece 21, 22 and communicates to it its displacement in the desired direction.

To improve the mechanical yield and especially to reduce friction, the window supports move without sliding in a groove 23 with an S profile through two friction rollers 24, 25.

Figure 2E:
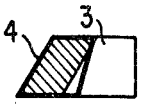
FIGS. 2A through 2E schematically represent the relative positions of the sliding windows corresponding to various positions of the command parts.
Figure 2D:
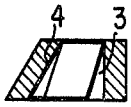
Figure 2C:
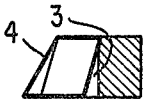
Figure 2B:
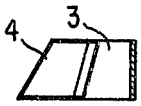
Figure 2A:
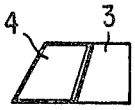
Figure 2:
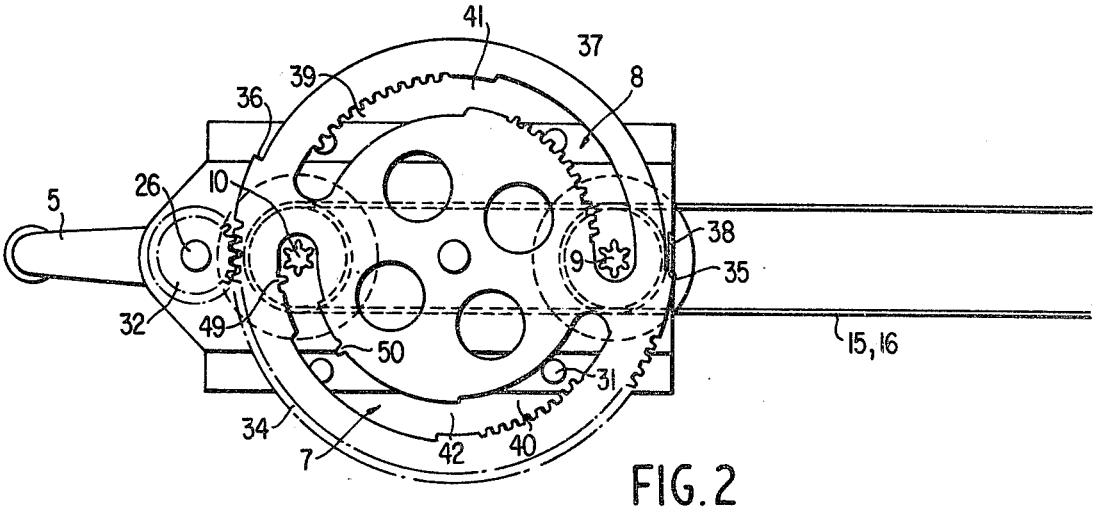
FIGS. 2, 3 and 4 represent, respectively seen in elevation, on the plane and from the side, the command parts, transformation parts, and movement transmission parts mounted on an assembled plate.
Figure 3:
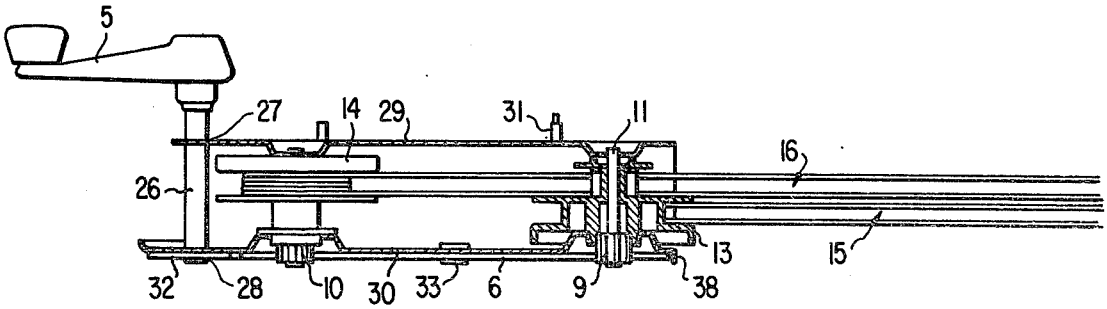
Figure 4:
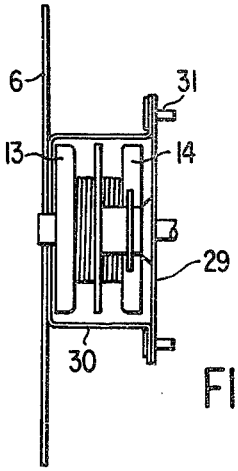

FIGS. 2 to 4 illustrate the motor part of the device, bringing together on an assembly plate the command and transmission parts whose role is to transform the circular movement of the crank into the necessary rectilinear movement for displacement of the panes.

The crank 5 is set on an axle 26 positioned between two bearings 27, 28 which are themselves arranged on two half-plates 29, 30 by screws 31 on the inside door panel, not shown. The end of the axle 26, opposite the crank, carries a pinion 32 which may be made of cut sheet metal or any other sufficiently resistant material to transmit the motor couple.

This pinion attacks the peripheral cog 34 of the command plate 6, pivoted on the half-plate 30 by an axle 33. The cogs of the plate occupy only a portion of the plate's circumference, sufficient to assure the total course required for displacement. The circular course of plate 6 is limited by two stops 35, 36 linked by a peripheral section 37 of the cogged sections 34 which is of lesser than the cogged sections, stops which may strike from one side or another a clamp 38 set on the half-plate 30 carrying the plate.

The plate 6 has two grooved areas in the form of sections 7, 8 which really constitute the command program for displacement of the windows, of which an operational example will be given at the end of the present description.

The cogged sections 7, 8 concentric and placed facing one another in the present version, form alternate racks with partial cogs alternately defining a succession of driving zones (for example 38, 40) for two receiver pinions 9, 10 and two rest zones (for example 41, 42) without cogs in one part or another of the section.

It is clear that rotation of plate 6 acts simultaneously on the two receiver pinions 9, 10 which are diametrically opposite by driving them or not in rotation as they are engaged or not by a cogged zone.

Figure 5:
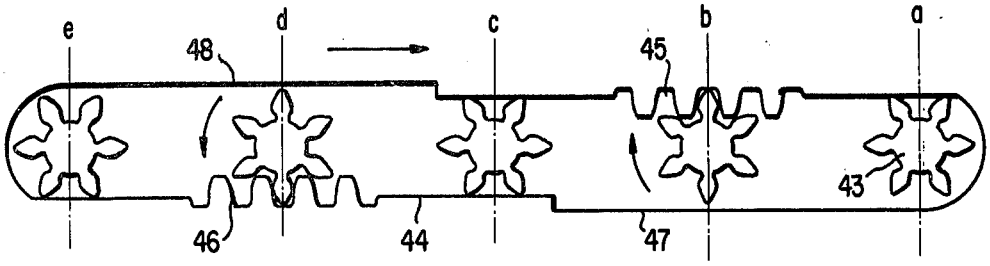
FIGS. 5 and 6 represent various positions of a receiver pinion in gear in a cog with alternating partial cogs, depending on the operational principle of the device.

The operational principle of the alternate rack, known in itself, is illustrated in FIG. 5 where a pinion 43 has been represented in various positions (a, b, c, d, e) corresponding to the course of a right rack 44. Starting from position a of the pinion on the extreme right, displacement towards the left of the rack successively takes the pinion to the five positions represented. The pinion successively engages the upper portion 45 and lower portions 46 of the rack while changing rotation direction. One thus witnesses a continuous rectilinear movement transformation (alternate for a round trip of the rack) in an alternate circular movement whose frequency depends on the number and separation of the cogged zones 45, 46.

Figure 6:
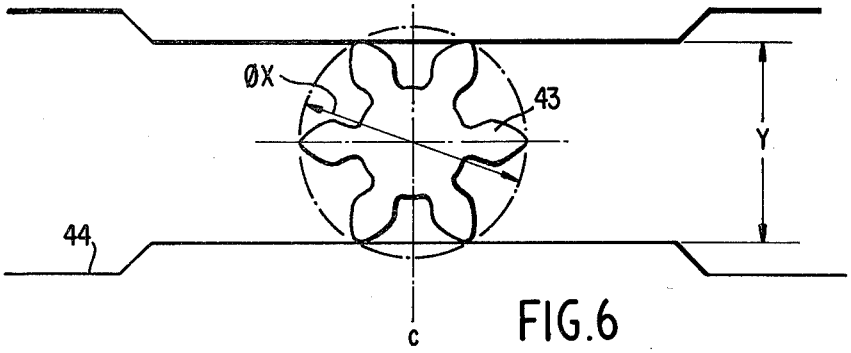

FIG. 6 represents the middle position c of the pinion 43 for which it is blocked in rotation without hindering the rectilinear displacement of the rack 44. In fact, the displacement at the top of the cogs of the pinion being a circumference with diameter X greater than the width Y of the rack, smaller at that point, the pinion cannot turn on itself. This characteristic is put to good use in the proposed application to assure blocking the windows 3, 4 in certain predetermined positions and consequently the inviolability of the vehicle from the outside, for example when the windows are closed.

The uncoupling zones 47, 48 planned for each driving zone 45, 46 are no obstacle to the blocking, for this can just as well be achieved with a single side of the pinion 43 as is the case for the two positions a, e of the pinion, represented in FIG. 5.

Referring to FIG. 2, it may be noted that there are extremely short driving zones 49, 50 which have only one or two cogs. This command program sequence may correspond to the case where one wishes only a slight opening of one of the panes while the other continues its course. All combinations are possible.

The receiver pinions 9, 10 are mounted on axles 11, 12 mounted in turn between the two half-plates 29, 30. By turning in one direction or another, each pinion brings into rotation a drum 13, 14 with helicoidal neck joined to the same axle and on which cable 15, 16 rolls. The drums are however shifted transversally so that the transmission cables do not interfere (FIG. 3).

Figure 7:
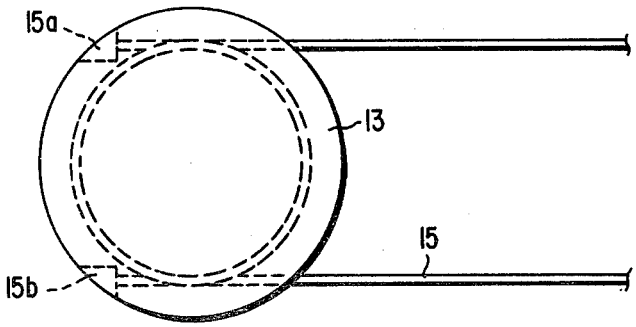
FIGS. 7 and 8 show in elevation and on the plane a drum for movement transmission by cable.
Figure 8:
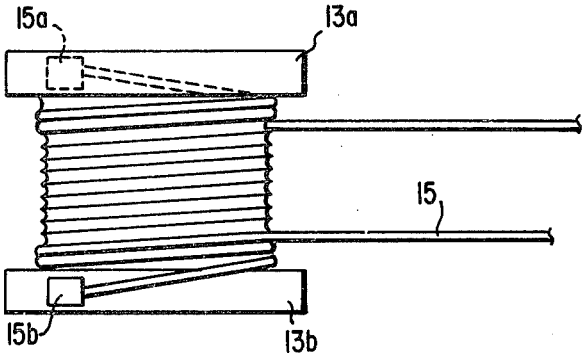
Figure 9:
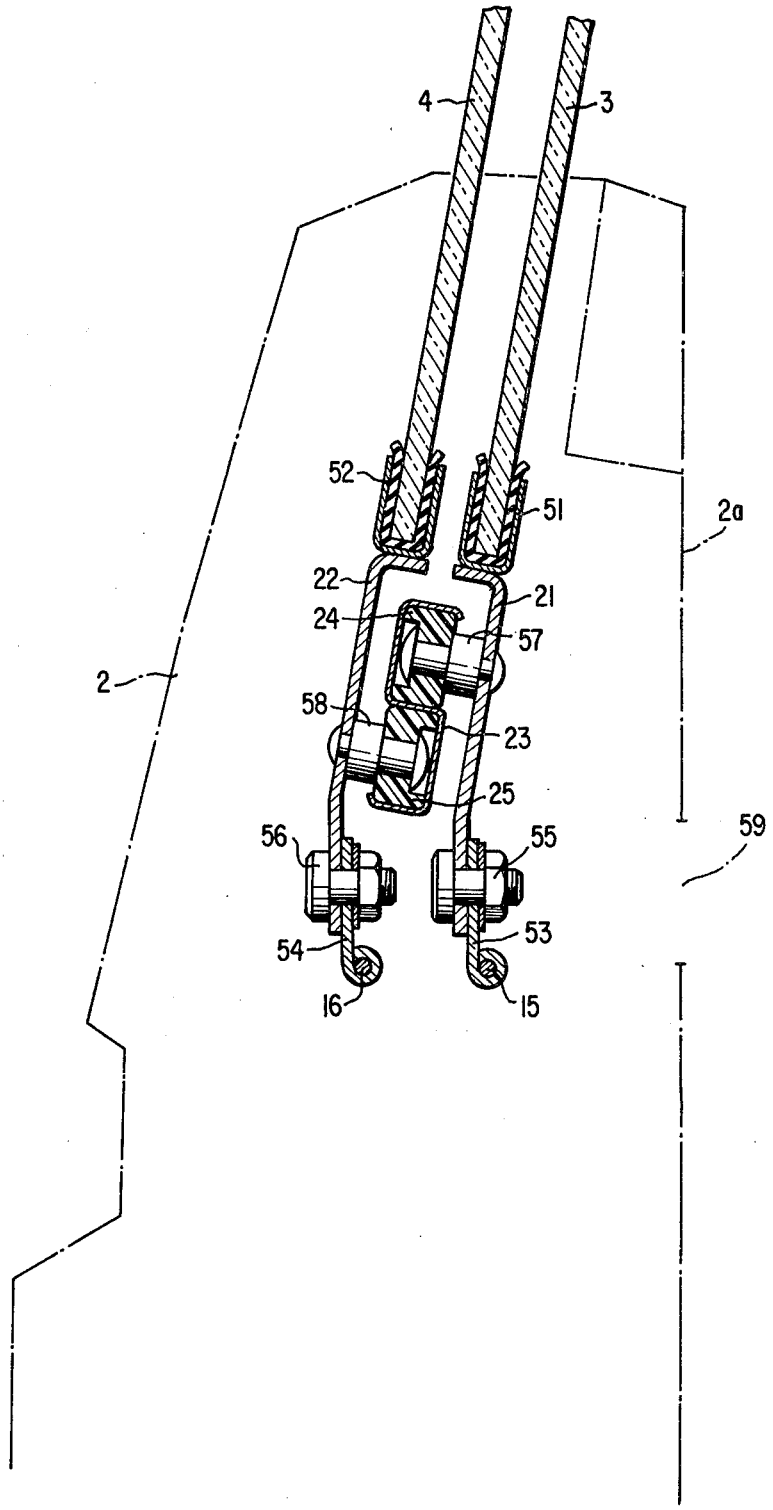
FIG. 9 represents transversally the link of the cables to the sliding windows by a slide bar set into the door case.

In conformity with FIGS. 7 and 8, each cable 15, 16 has its ends **15*a*, 15*b* blocked in the side plates 13*a*, 13*b* of the drum so as to form, each with two loose pulleys (17 to 20) mounted on the body (FIG. 1) two closed triangular circuits with constant length and regulatable tension, preventing any undesirable sliding (FIG. 1). This device, already known, permits rolling out one side while rolling up the other when the drum is driven by the corresponding receiver pinion. The mechanism which has just been described transforms the alternate circular movement of the receiver pinions 9, 10 into an alternate rectilinear displacement of each of the straight portions of the cables 15, 16, especially the upper portion linked to the supports 21, 22 of windows or panels described hereafter to FIG. 9**.

The two panes, respectively exterior 4 and interior 3, displaced to allow their overlapping recovery, are mounted tightly into a classic window base 51, 52 including a U-piece provided with an internal lining and lengthened behind by a support piece 21, 22 linked in turn to the transmission cable 15, 16 by a clamp 53, 54 encased on said cable and screwed onto the support (55, 56). Furthermore, two pairs of rollers 24, 25 are positioned on the support pieces by axles 57, 58 riveted according to the superimposed plans so that the rollers belonging to one or another of the windows can roll without sliding on the respective tracks of a slide bar 23 with S profile mounted on the door case 2. Panes 3, 4 can thus freely crossed from one end to the other of the door window.

The placement of cables 15, 16 on the support pieces 21, 22 is made by orifices 59 arranged on the interior panel **2*a* of the door, after placing the other parts of the device, especially the command plate 6 placed opposite and movement transmission parts 15, 16** inside the door case.

In the proposed application, the represented configuration of the command plate 6 permits the following operational sequences (referring to FIG. 2):

It will be assumed that the upper 8 and lower 7 sections of the plate are respectively affected by driving the interior 3 and exterior 4 panes, i.e., the right and left panes from position A, closed windows, represented in the upper righthand corner of the figure.

The position of the receiver pinions 9, 10 being fixed in relation to plate 6, the represented angular positions (A to E) are intended to contrive a corresponding rotation of plate 6 so as to bring about said positions coinciding with the diametrically opposite pinions.

Noting that the interior cogged zones, i.e., those of lesser radius, will displace the panes towards the left of the window and the exterior cogged zones displace them towards the right, one can easily understand the various intermediate positions represented in the five schematic figures. For more clarity, the exterior pane 4 is represented in heavy lines and the interior pane 3 in light lines, the air surfaces of the windows being hatchedmarked.

One thus obtains displacement of the windows, simultaneous or not, in the same direction or opposite directions, to meet the various needs of ventilation and comfort of the vehicle's passengers. By way of example, positions B and D correspond to simultaneous slight openings of the windows position C corresponds to complete opening of the interior pane 3, and position E to complete opening of the exterior pane 4.

To modify this sequence and plan for other ventilation possibilities, it is sufficient to replace the command plate 6 by another including a different program, notably by the placement, number, and length of the cogged zones.

Numerous variations may be made on the described version. It is in this way especially that, in order to reduce the size of plate 6, one may provide concentric sections with different diameters in which the course would go beyond the half-circle.

The invention is not linked to the circular form of the command part 6. One could just as well plan an interchangeable part with rectilinear racks guided between two blades.

In the case of panes pivoting around an axle and thus being bent in shape, transmission by cable and direct slide bar may be replaced by an already known system including a flexible cable having an external helicoidal threading for engagement with the auxiliary pinion mounted on the axle of the receiver pinions while the cable sheath would serve as slide bar for the windows.

It goes without saying that the device according to the invention might find numerous applications for driving sliding windows in a domain other than automobiles.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for driving sliding panels, particularly horizontally sliding windows in an automobile, according to a predetermined operational sequence, said apparatus comprising:

a rotatable crank;

a movable plate rotatably driven about an axis by said crank, said movable plate having a radius and a plurality of concentric grooved sections having different average radii, all of which are smaller than said radius of said movable plate;

a first pinion for each said panel, each said first pinion having an axle;

partial cogs on said grooved sections forming alternate racks intermittently drivingly engagable with each said pinion;

a panel support connected to each said panel; and a transmission cable connected to each said first pinion and drivingly engaging each said panel support;

whereby rotation of said crank is transmitted through said movable plate, said pinion, said transmission cable, and said panel support to alternatively drive each said panel.

2. The device recited in claim 1 wherein:

each grooved section alternately defines at least one driving zone of each said pinion, said zone being of variable length separated by reset zones without cogs and of lesser widths formed by the circumferential overlap of two of said driving zones, each said pinion remaining blocked in rotation by said reset zones without interrupting movement of said plate.

3. The device recited in claim 1 including:

a drum supported by the axle of the pinion and having a helicoidal neck;

a pair of pulleys;

the transmission cable being wound about the drum and the pair of pulleys and defining a triangular trajectory of constant length.

4. The device recited in claim 3 including:

a fixed slide bar with a groove having a S-profile; and the panels include a plurality of rollers engaging the groove.

5. The device recited in claim 1 including:

an auxiliary pinion mounted on the axle of the first pinion and wherein the transmission cable is made with an external helicoidal threading for engagement with the auxiliary pinion, the panel supports sliding on the sheath of the cable.

* * * * *